US010799048B2

(12) United States Patent
Little et al.

(10) Patent No.: US 10,799,048 B2
(45) Date of Patent: Oct. 13, 2020

(54) BUTTON AFFIXING DEVICE

(71) Applicants: Jesse Little, Lindenhurst, NY (US); Timothy Little, Lindenhurst, NY (US); Cynthia Little, Lindenhurst, NY (US); Charles Garrison, Greenlawn, NY (US)

(72) Inventors: Jesse Little, Lindenhurst, NY (US); Timothy Little, Lindenhurst, NY (US); Cynthia Little, Lindenhurst, NY (US); Charles Garrison, Greenlawn, NY (US)

( * ) Notice: Subject to any disclaimer, the term of this patent is extended or adjusted under 35 U.S.C. 154(b) by 45 days.

(21) Appl. No.: 16/189,923

(22) Filed: Nov. 13, 2018

(65) Prior Publication Data

US 2019/0075953 A1 Mar. 14, 2019

Related U.S. Application Data

(63) Continuation-in-part of application No. 15/728,030, filed on Oct. 9, 2017, now Pat. No. 10,165,886.

(60) Provisional application No. 62/506,919, filed on May 16, 2017.

(51) Int. Cl.
*A47G 25/92* (2006.01)
*A47G 25/90* (2006.01)

(52) U.S. Cl.
CPC ..... *A47G 25/90* (2013.01); *A47G 25/92* (2013.01)

(58) Field of Classification Search
CPC ..... A47G 25/90; A47G 25/92
See application file for complete search history.

(56) References Cited

U.S. PATENT DOCUMENTS 342,643 A * 5/1886 Sellman ..... B25B 13/28 81/112
416,932 A * 12/1889 Mabie ..... A47G 25/92 24/40
424,683 A * 4/1890 Murray ..... A47G 25/92 24/40
429,661 A * 6/1890 Sullivan ..... A47G 25/92 24/40
518,619 A * 4/1894 Muir ..... A47G 25/92 24/40
684,915 A * 10/1901 Crandall ..... A47G 25/92 24/40
687,135 A * 11/1901 Dolloff ..... A47G 25/92 24/40
878,598 A * 2/1908 Bailey ..... A47G 25/92 24/40
979,342 A * 12/1910 Schaefer ..... A47G 25/92 24/40

(Continued)

*Primary Examiner* — Jason W San

(57) ABSTRACT

A button affixing device is an apparatus that is used to assist a user in joining clothing buttons to their assigned hole. The apparatus includes a static arm, a dynamic arm, a hollow handle, a spring, a first claw, a second claw, and a trigger. The static arm is utilized for positioning of the first claw. The dynamic arm arranges the position of the second claw and slides relative to the static arm. The hollow handle provides the user a means of grasping the apparatus during use. The spring is a curved unit that expands and contracts to transmit energy to the dynamic arm. The first claw is a curved rigid segment of the static arm, and the second claw is a curved rigid segment of the dynamic arm. The trigger may be utilized to move the dynamic arm towards the spring.

8 Claims, 6 Drawing Sheets

(56) References Cited

U.S. PATENT DOCUMENTS 1,074,649 A * 10/1913 Schwery ..... A47G 25/92 24/40
1,101,557 A * 6/1914 Lister et al. ..... A47G 25/92 24/40
1,355,176 A * 10/1920 Smolarski ..... A47G 25/92 24/40
1,423,782 A * 7/1922 Szigethy ..... A47G 25/92 24/40
1,499,504 A * 7/1924 Colton ..... A47G 25/92 24/40
1,879,903 A * 9/1932 Kleiber ..... A47G 25/92 24/40
2,115,545 A * 4/1938 Yumont ..... A47G 25/92 24/40
3,683,459 A * 8/1972 Johansen ..... A44B 3/00 24/40
4,183,570 A * 1/1980 Broyles ..... E01H 1/12 294/61
4,502,722 A * 3/1985 Rocquin ..... E01H 1/12 294/61
5,150,505 A * 9/1992 Drabek ..... A47G 25/92 29/278
7,721,394 B2 * 5/2010 Snyder ..... A47G 25/92 24/40
9,005,220 B2 * 4/2015 Wallace ..... A61B 17/0469 606/144
9,603,476 B2 * 3/2017 Carman ..... A47G 25/92
2007/0119018 A1 * 5/2007 Snyder ..... A47G 25/92 16/8
2008/0222852 A1 * 9/2008 Stephan ..... A47G 25/92 24/40
2015/0245725 A1 * 9/2015 Benjamin ..... A47G 25/902 294/3.6
2016/0288316 A1 * 10/2016 Wright ..... B26B 13/14
2017/0360232 A1 * 12/2017 Windows, Jr. ..... A47G 25/92
2018/0220825 A1 * 8/2018 Havivy ..... A47G 25/908
2018/0332991 A1 * 11/2018 Little ..... A47G 25/92
2019/0290043 A1 * 9/2019 Zoulamian ..... A47G 25/902

* cited by examiner

BUTTON AFFIXING DEVICE

The current application is a continuation-in-part (CIP) application of the U.S. non-provisional application Ser. No. 15/728,030 filed on Oct. 9, 2017. The U.S. non-provisional application Ser. No. 15/728,030 claims a priority to a U.S. provisional application Ser. No. 62/506,919 filed on May 16, 2017.

FIELD OF THE INVENTION

The present invention generally relates to an apparel interaction device. More specifically, the present invention is a button affixing device that improves the user's ability to slide the button of a shirt or pants through the corresponding keyhole slot of the clothing.

BACKGROUND OF THE INVENTION

The button-up shirt has been available for hundreds of years. Similarly, other clothing, such as jackets, pants, button-down shirts, certain pockets, and more have made extensive use of buttons and button holes as a means of securing clothing in place. Buttons themselves are cheap to manufacture and easy to add to different types of apparel to allow that apparel to tighten and retain shape to an extent during use. The method for attaching a button to a button hole is simple enough in theory: the user pinches the button by the edge, presses the button through the button hole, and pulls the back edge of the button through.

However, such motion is difficult for many people. Elderly or handicapped people often have difficulty managing to perform the steps outlined above. Fine motor control tends to deplete as the human body ages, resulting in difficulty grasping the button and pressing it through the button hole. What was once a simple, even one-handed task is now a struggle that can make it difficult for an elderly person to make appearances in a timely fashion. For handicapped people as well as elderly people, it can be embarrassing asking for help buttoning a shirt. What is needed is a device that can aid an elderly or handicapped person in securing a button through a button hole. Further desirable is a device that is lightweight and easy to use, and that can assist a user in removing buttons when removing clothing.

The present invention addresses these issues. The button affixing device has a handle that is easy for a user to grasp and use. A claw extends away from the handle, and a sliding, spring-loaded claw on the opposite side allows the present invention to grasp a button. The long neck of the present invention is shaped to easily slide through a button hole. The user can then grasp the button by pulling a trigger back towards the handle and releasing when the button is between the two claws. The user then pulls the handle and claws back through the button hole. Once the button is fully through the button hole, the user pulls the trigger again to release the button in its proper, affixed position. When the user is finished wearing the buttoned clothing, the user can grasp the button again between the claws of the present invention and subsequently direct the button back through the hole.

DETAILED DESCRIPTION OF THE INVENTION

All illustrations of the drawings are for the purpose of describing selected versions of the present invention and are not intended to limit the scope of the present invention.

Figure 1:
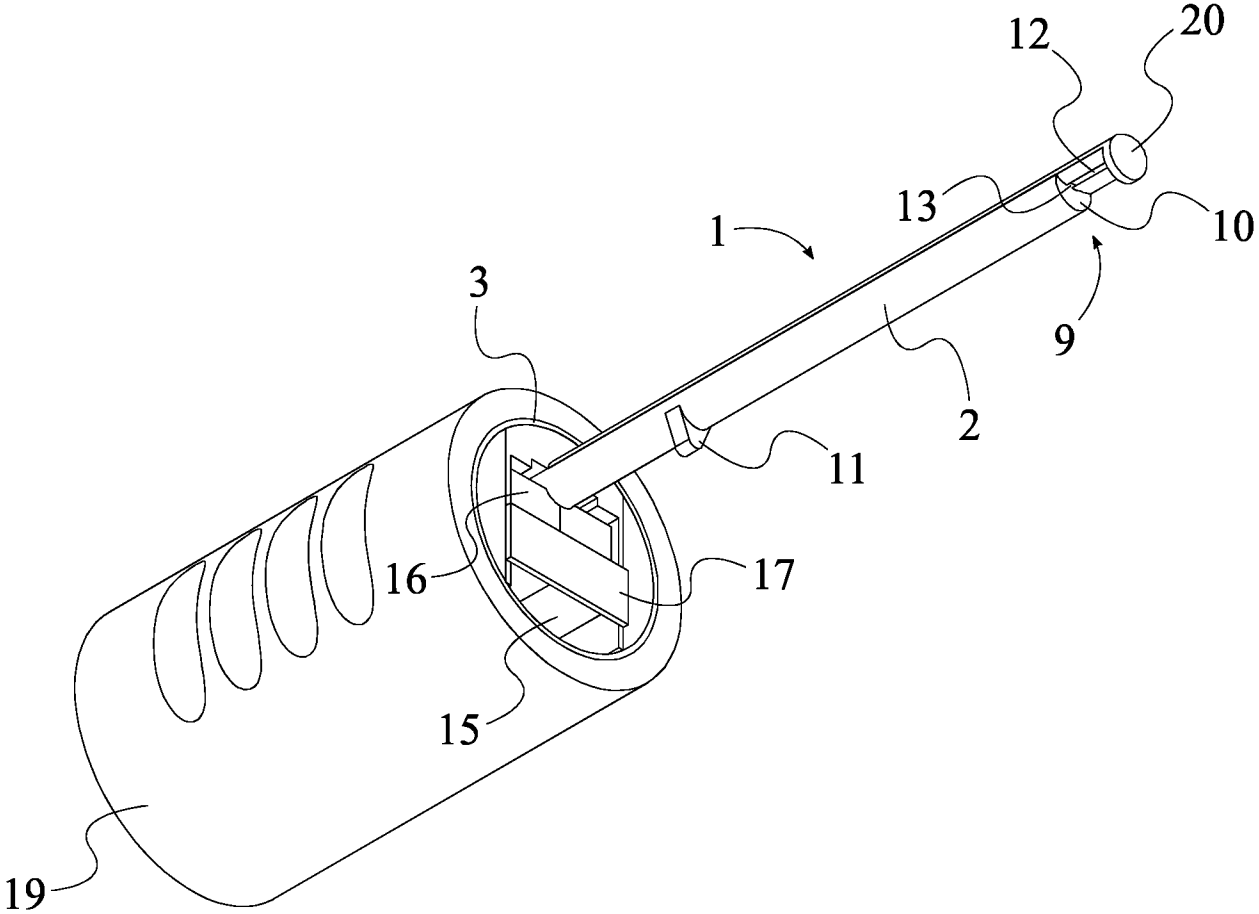
FIG. 1 is a front-left perspective view of the present invention.

The present invention is a button affixing device that is used to assist a user in joining clothing buttons to their assigned hole. The present invention is configured to provide a convenient mechanism for grasping and subsequently manipulating the position of a button. The present invention comprises a static arm 1, a dynamic arm 2, a hollow handle 3, a spring 4, a first claw 7, a second claw 9, and a trigger 11, as seen in FIG. 1. The static arm 1 is an extended rigid member that is utilized for positioning of the first claw 7. The dynamic arm 2 is an extended member that arranges the position of the second claw 9 and slides relative to the static arm 1. The hollow handle 3 is a generally cylindrical unit that provides the user a means of grasping the present invention. The spring 4 is a curved unit that expands and contracts to transmit mechanical potential energy to the dynamic arm 2. The first claw 7 is a curved rigid segment of the static arm 1. Similarly, the second claw 9 is a curved rigid segment of the dynamic arm 2. The trigger 11 is a rigid protrusion that may be utilized to actuate the dynamic arm 2.

Figure 3:
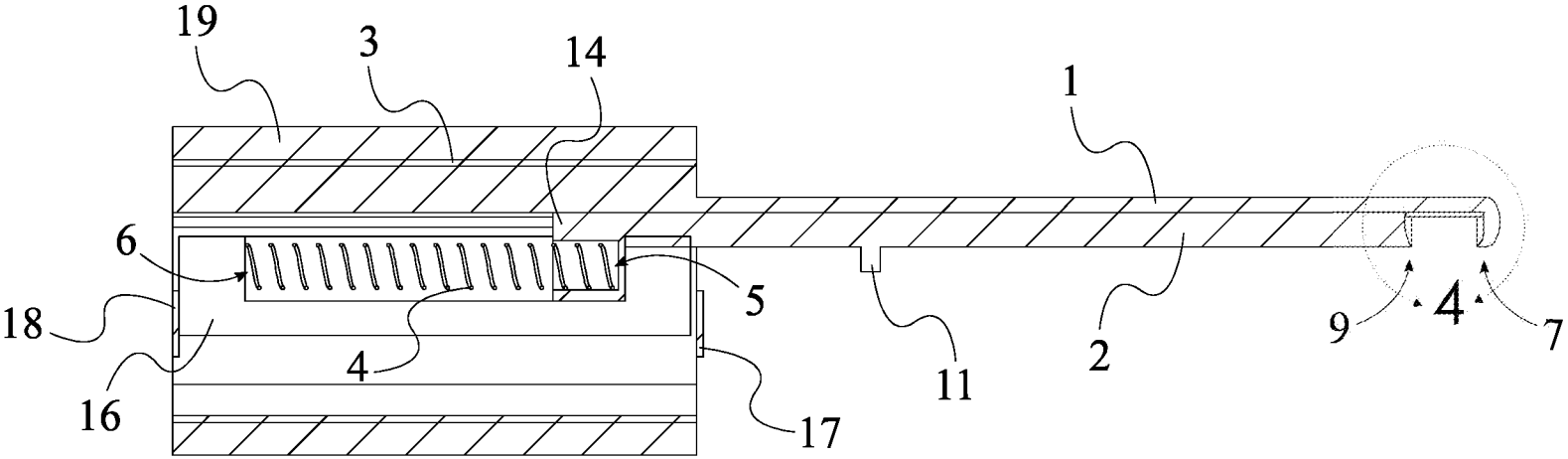
FIG. 3 is a cross-sectional view about line 3-3.

The general configuration of the aforementioned components allows the present invention to efficiently and effectively insert clothing buttons into button holes. The spring 4 comprises a first spring end 5 and a second spring end 6. The first spring end 5 and the second spring end 6 allow for appropriate application of spring force to the dynamic arm 2, as seen in FIG. 3. The static arm 1 and the dynamic arm 2 are slidably connected to each other. This arrangement allows the dynamic arm 2 to move relative to the static arm 1 along a shared axis. The hollow handle 3 is terminally connected to the static arm 1. In this way, the user can control the position of the static arm 1 by grasping the hollow handle 3. The dynamic arm 2 traverses into the hollow handle 3. This arrangement allows the user to maneuver the dynamic arm 2 while grasping the hollow handle 3. The spring 4 is positioned within the hollow handle 3. In this way, the spring 4 is positioned to apply forces against the hollow handle 3. The first spring end 5 is terminally connected to the dynamic arm 2. Similarly, the second spring end 6 is connected within the hollow handle 3. This arrangement enables the application of spring force from the hollow handle 3 to the dynamic arm 2, biasing the dynamic arm 2 away from the hollow handle 3. The first claw 7 is terminally connected to the static arm 1, opposite the hollow handle 3. This arrangement results in an elongated static arm 1 that can easily reach through a button hole to the opposing button. The second claw 9 is terminally connected to the dynamic arm 2, opposite to the hollow handle 3. This arrangement results in the first claw 7 and second claw 9 being positioned offset from each other, resulting in the ability of the first claw 7 and the second claw 9 to grip buttons. The trigger 11 is laterally connected to the dynamic arm 2. This allows the motion of the trigger 11 to control the position of the dynamic arm 2, and consequently, the position of the second claw 9.

Figure 5:
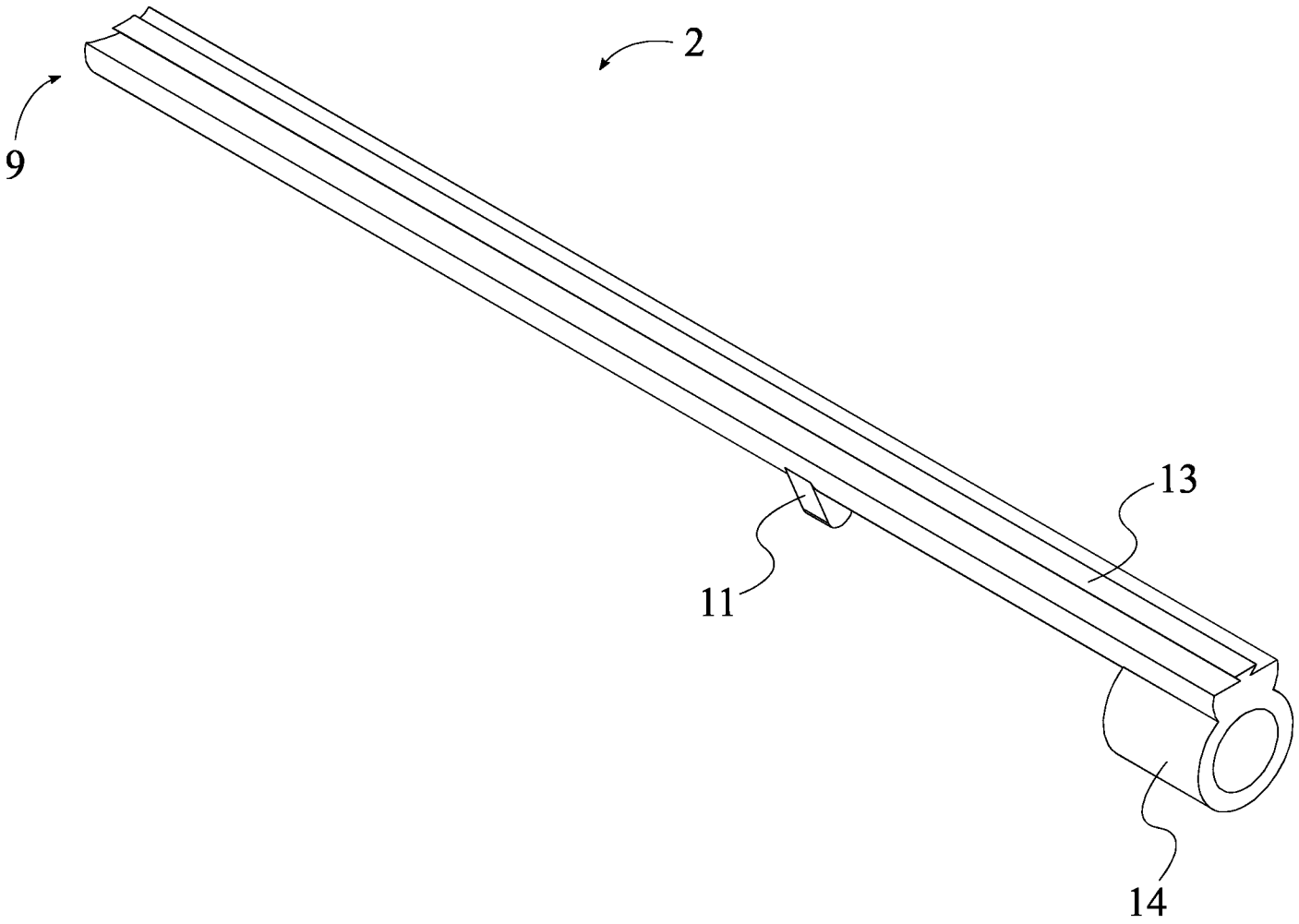
FIG. 5 is a rear-right perspective view of the dynamic arm.
Figure 6:
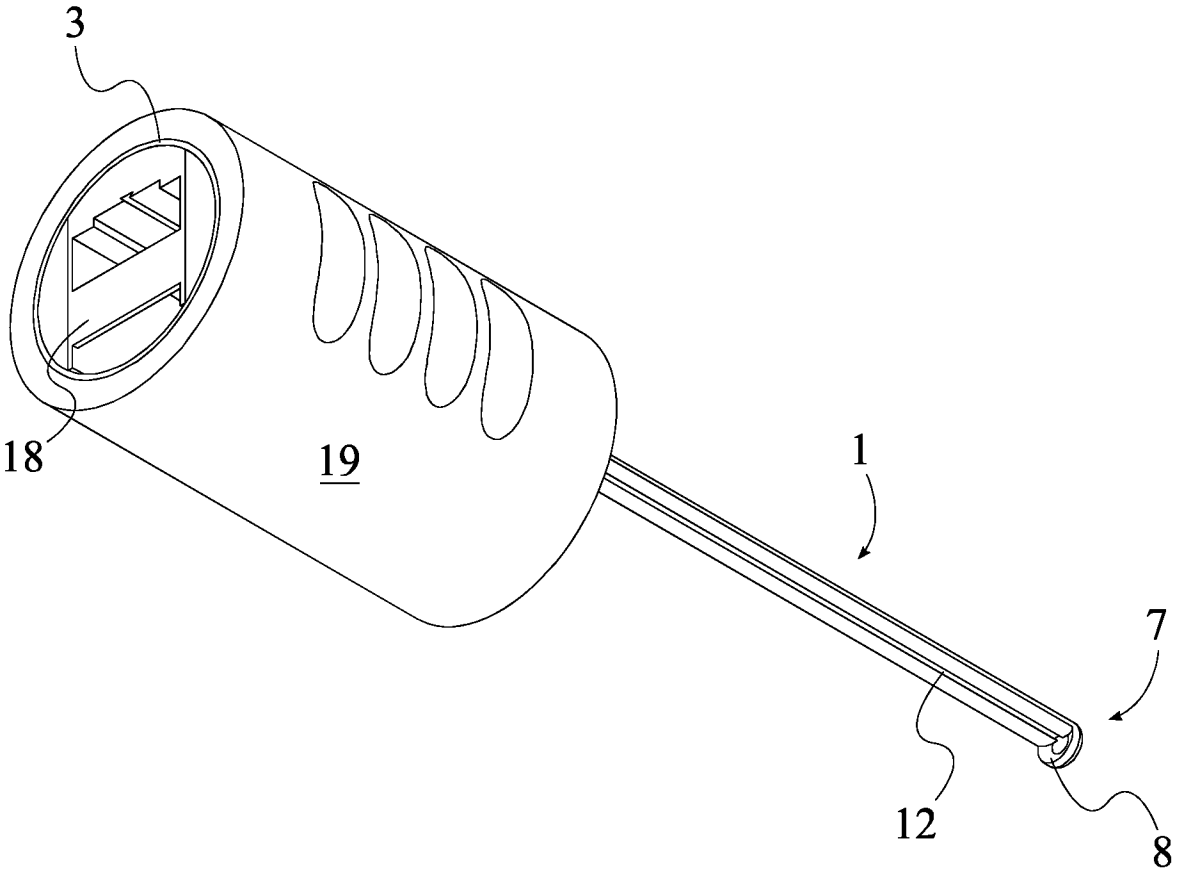
FIG. 6 is a rear-left perspective view of the static arm and the hollow handle.

For proper movement of the second claw 9 relative to the first claw 7, the dynamic arm 2 must be properly engaged to the static arm 1. To this end, the present invention comprises a track channel 12 and a guide rail 13, as seen in FIGS. 5 and 6. The track channel 12 is a cut extending along the length of the static arm 1. The guide rail 13 is a protrusion extending along the length of the dynamic arm 2, opposite the track channel 12. The track channel 12 laterally traverses into the static arm 1. This allows the static arm 1 to receive the guide rail 13. The guide rail 13 is laterally connected along the dynamic arm 2. In this way, the track channel 12 and the guide rail 13 allow for appropriate connection of the dynamic arm 2 to the static arm 1. The guide rail 13 is slidably engaged into the track channel 12. This arrangement ensures that the dynamic arm 2 is appropriately arranged relative to the static arm 1, and that movement of the dynamic arm 2 is restricted to motion along the length of the static arm 1. In an exemplary embodiment, the track channel 12 and the guide rail 13 are shaped to keep the static arm 1 and the dynamic arm 2 in contact with each other. In a preferred embodiment, a trapezoidal cross-section of the track channel 12 is perimetrically offset from a trapezoidal cross-section of the guide rail 13. This arrangement ensures that the guide rail 13 cannot lift or separate from the track channel 12.

Figure 2:
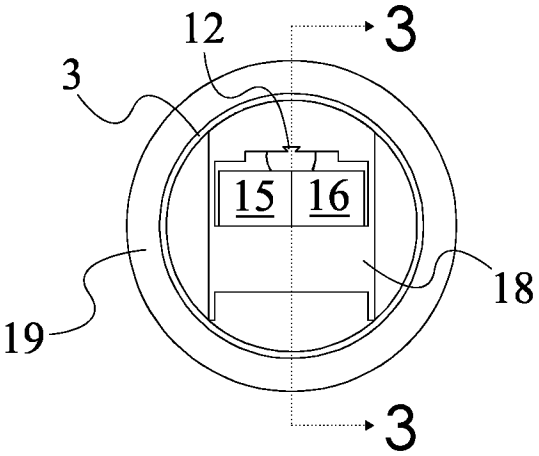
FIG. 2 is a rear perspective view of the present invention.

The present invention requires a mechanism for accommodating the spring 4 and properly orienting the spring 4 relative to the dynamic arm 2. To this end, the present invention further comprises a carriage 14, a first elongated brace 15, and a second elongated brace 16. The carriage 14 is a rigid segment that allows for proper interaction with the spring 4. The first elongated brace 15 is a rigid unit that positions the spring 4, the carriage 14, and the second elongated brace 16, as seen in FIG. 2. The second elongated brace 16 is a rigid unit that positions the spring 4, the carriage 14, and the first elongated brace 15. The first elongated brace 15 is pressed laterally against the carriage 14. Similarly, the second elongated brace 16 is laterally pressed against the carriage 14, opposite the first elongated brace 15. This arrangement allows the first elongated brace 15 and the second elongated brace 16 to work together in arranging the carriage 14. The dynamic arm 2 is laterally connected to the carriage 14. In this way, pressure or energy applied to the carriage 14 transmits to the dynamic arm 2, influencing the position of the dynamic arm 2, and consequently the position of the second claw 9. The spring 4 is positioned in between the first elongated brace 15 and the second elongated brace 16. This arrangement ensures that the spring 4 is retained in position during use. The first spring end 5 is connected to the carriage 14. This arrangement results in forces applied to the spring 4 traveling from the first elongated brace 15 and the second elongated brace 16 through the carriage 14 and the dynamic arm 2 to the second claw 9.

According to the above arrangement of components, the dynamic arm 2 has a degree of freedom along the direction of the static arm 1; however, there is no limit to the distance the dynamic arm 2 can travel. To this end, the present invention comprises a first stop 17 and a second stop 18, as seen in FIG. 3. The first stop 17 is a unit that is used primarily to position the second stop 18. The second stop 18 is a rigid segment that prevents the dynamic arm 2 from exerting undue pressure upon the spring 4 and prevents the dynamic arm 2 from sliding through the hollow handle 3. The first stop 17 and the second stop 18 are connected in between the first elongated brace 15 and the second elongated brace 16. This arrangement joins the first elongated brace 15 and the second elongated brace 16. The first stop 17 and the second stop 18 are positioned opposite to each other along the first elongated brace 15 and the second elongated brace 16. In this way, the first stop 17 is positioned to limit motion of the dynamic arm 2 towards the first claw 7, and the second stop 18 is positioned to limit motion of the dynamic arm 2 away from the first claw 7. The carriage 14 and the spring 4 are positioned in between the first stop 17 and the second stop 18. This arrangement ensures that the spring 4 is in constant tension with the carriage 14, thus preventing jerky or damaging unintended motion of the spring 4 relative to the carriage 14. The second spring end 6 is pressed against the second stop 18. In this way, pressure applied to the second stop 18 travels through the spring 4 to the dynamic arm 2, biasing the dynamic arm 2 away from the hollow handle 3.

Figure 4:
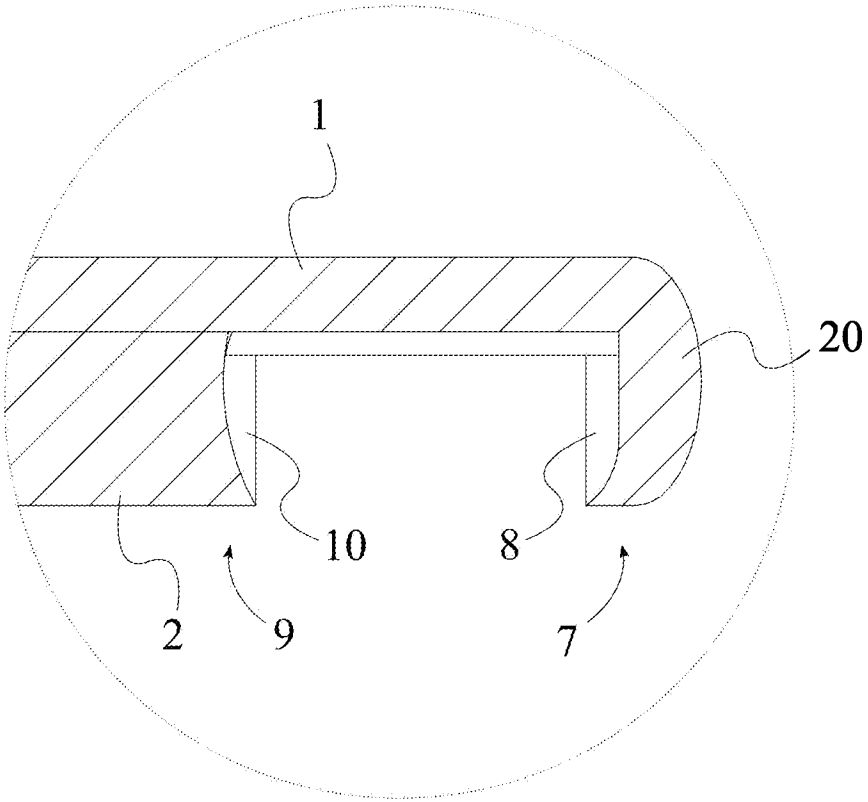
FIG. 4 is a cross-sectional view taken along line 3-3 in FIG. 2 and a detail view taken about circle 4 in FIG. 3 of the first claw and the second claw.

The first claw 7 and the second claw 9 must be shaped correctly to enable enclosure of a button. To this end, the first claw 7 comprises a first concave surface 8. Further, the second claw 9 comprises a second concave surface 10. The first concave surface 8 and the second concave surface 10 are curved surfaces that respectively improve the ability of the first claw 7 and the second claw 9 to engage with the shape of a button, as seen in FIG. 4. The first concave surface 8 is oriented towards the second claw 9. Further, the second concave surface 10 is oriented towards the first claw 7. This arrangement allows the first concave surface 8 and the second concave surface 10 to interact with each other, thus improving the ability of the present invention to retain buttons during the process of pulling buttons through a button hole.

The trigger 11 requires an amount of space to allow the user to slide the dynamic arm 2 towards the spring 4. The trigger 11 is positioned offset from the hollow handle 3, as seen in FIG. 5. In this way, the trigger 11 can be used to move the dynamic arm 2 when used in conjunction with the hollow handle 3. The hollow handle 3 may be of a variety of different shapes and sizes. In an exemplary embodiment, the present invention further comprises an ergonomic grip 19. The ergonomic grip 19 is a unit made of comfortable, high-friction, or otherwise grip-enhancing materials with protrusions that match the space between the user's fingers. The ergonomic grip 19 is connected around the hollow handle 3. In this way, the ergonomic grip 19 improves the user's hold of the hollow handle 3 during use.

The user needs to be able to slide the present invention into and out of a button hole easily. Therefore, the present invention further comprises a blunted end 20. The blunted end 20 is a preferably rounded shape that, in the preferred usage of the present invention, is the first thing to enter into a button hole. The blunted end 20 is terminally integrated into the static arm 1, opposite to the hollow handle 3, as seen in FIG. 1. In this way, the static arm 1 follows the blunted end 20 into a button hole during use. To further ease the ability of the present invention to slide into and out of a button hole, the dynamic arm 2 tapers from the second claw 9 to the trigger 11. This arrangement results in the positioning of button holes at a relatively standard distance from the hollow handle 3, thus easing the repeated usage of the present invention while putting on a shirt or other multi-button garment.

Although the invention has been explained in relation to its preferred embodiment, it is to be understood that many other possible modifications and variations can be made without departing from the spirit and scope of the invention as hereinafter claimed.

What is claimed is:

1. A button affixing device comprises:

a static arm;

a dynamic arm;

a hollow handle;

a spring;

a first claw;

a second claw;

a trigger;

the spring comprises a first spring end and a second spring end;

the static arm and the dynamic arm being slidably connected along each other;

the hollow handle being terminally connected to the static arm;

the dynamic arm traversing into the hollow handle;

the spring being positioned within the hollow handle;

the first spring end being terminally connected to the dynamic arm;

the second spring end being connected within the hollow handle;

the first claw being terminally connected to the static arm, opposite the hollow handle;

the second claw being terminally connected to the dynamic arm, opposite to the hollow handle;

the trigger being laterally connected to the dynamic arm;

a track channel;

a guide rail;

the track channel laterally traversing into the static arm;

the guide rail laterally connected along the dynamic arm;

the guide rail being slidably engaged into the track channel; and a trapezoidal cross-section of the track channel being perimetrically offset from a trapezoidal cross-section of the guide rail.

2. The button affixing device as claimed in claim 1 comprises:

a carriage;

a first elongated brace;

a second elongated brace;

the first elongated brace being laterally pressed against the carriage;

the second elongated brace being laterally pressed against the carriage, opposite the first elongated brace;

the dynamic arm being laterally connected to the carriage;

the spring being positioned in between the first elongated brace and the second elongated brace; and the first spring end being connected into the carriage.

3. The button affixing device as claimed in claim 2 comprises:

a first stop;

a second stop;

the first stop and the second stop being connected in between the first elongated brace and the second elongated brace;

the first stop and the second stop being positioned opposite to each other along the first elongated brace and the second elongated brace;

the carriage and the spring being positioned in between the first stop and the second stop; and the second spring end being pressed against the second stop.

4. The button affixing device as claimed in claim 1 comprises:

the first claw comprises a first concave surface;

the second claw comprises a second concave surface;

the first concave surface being oriented towards the second claw; and the second concave surface being oriented towards the first claw.

5. The button affixing device as claimed in claim 1 comprises:

the trigger being positioned offset from the hollow handle.

6. The button affixing device as claimed in claim 1 comprises:

an ergonomic grip; and the ergonomic grip being connected around the hollow handle.

7. The button affixing device as claimed in claim 1 comprises:

a blunted end; and the blunted end being terminally integrated into the static arm, opposite to the hollow handle.

8. The button affixing device as claimed in claim 1 comprises:

the dynamic arm tapering from the second claw to the trigger.

* * * * *